US005451429A

United States Patent [19]

Chapman

[11] Patent Number: 5,451,429

[45] Date of Patent: Sep. 19, 1995

[54] METHOD AND APPARATUS FOR TREATING FRESHLY METALLIZED SUBSTRATES

[75] Inventor: Robert D. Chapman, Harrogate, England

[73] Assignee: The BOC Group plc, Windlesham, United Kingdom

[21] Appl. No.: 292,865

[22] Filed: Aug. 19, 1994

[30] Foreign Application Priority Data

Aug. 27, 1993 [GB] United Kingdom ..... 9317920

[51] Int. Cl.[6] ..... C23C 16/00

[52] U.S. Cl. ..... 427/250; 427/404; 427/431; 427/432

[58] Field of Search ..... 427/250, 404, 431, 432

[56] References Cited

U.S. PATENT DOCUMENTS

| | | | |
|---|---|---|---|
| 2,276,232 | 3/1942 | Gilbert | 427/432 |
| 2,405,221 | 8/1946 | Mann | 427/432 |
| 3,484,280 | 12/1969 | Carreker, Jr. | 427/432 |
| 3,700,486 | 10/1972 | Veltri et al. | 427/432 |
| 3,987,224 | 10/1976 | Brinkmann et al. | 427/432 |
| 4,821,947 | 4/1989 | Nowatarski | 427/432 |

*Primary Examiner*—Shrive Beck
*Assistant Examiner*—Benjamin L. Utech
*Attorney, Agent, or Firm*—R. Hain Swope; David A. Draegert; Larry R. Cassett

[57] ABSTRACT

A method and apparatus for treating a freshly metallized substrate in which a metal substrate is passed through a bath of molten metal for the purpose of applying a coating thereto while a treating gas containing a reducing gas, a non-oxidizing gas or combination thereof is provided at the region where the metallized substrate exits the molten metal bath to thereby at least reduce oxidation of the metallized substrate and the surface of the molten metal bath.

8 Claims, 1 Drawing Sheet

METHOD AND APPARATUS FOR TREATING FRESHLY METALLIZED SUBSTRATES

FIELD OF THE INVENTION

The present invention is directed to the treatment of freshly metallized substrates to prevent oxidation thereof and particularly, but not exclusively, to the treatment of metallized wires or strips by passing a metal wire or strip through a bath of a molten metal to form a coating thereon. The present invention is particularly adapted to the use of a treating gas containing a reducing gas and/or a non-oxidizing gas to at least reduce oxidation of the metallized wires or strips.

BACKGROUND OF THE INVENTION

Galvanization of wire is carried out commercially by passing the wire through a bath of molten metal, such as zinc. The freshly galvanized wire is particularly susceptible to oxidation at the location where it breaks the surface of the molten zinc bath. In addition, there tends to be a build-up of zinc oxide particles on the surface of the bath and these particles tend to adhere to the wire. To prevent adhesion of zinc oxide particles to the metallized wire it is common practice to employ a layer of charcoal impregnated with oil at the location where the wire breaks the surface of the molten zinc bath. This practice helps to clean the wire of any particles of zinc oxide "ash" loosely adhering to it and also helps to protect the freshly galvanized surface of the wire from oxidation.

There are however a number of drawbacks to this process. The charcoal needs regular replenishment. Erosion of the charcoal reduces the protection against oxidation and the pick-up of zinc oxide particles.

An alternative method of protecting the emerging freshly galvanized wire from oxidation is to employ a shroud around the location where the wire leaves the surface of the molten zinc. A gas that does not react with the zinc to form zinc oxide, such as nitrogen or argon, is passed into the region defined by the shroud, so as to maintain the region around the emerging galvanized wire relatively free of oxygen as compared to air. Applicant has observed that such regions occupied by nitrogen or argon as the protective gas produce better quality wires for a short period of time. It has been found however that over prolonged periods of operation there remains a build up of zinc oxide around the surface of the emerging galvanized wire which has a deleterious effect on the quality of the wire. As a consequence, the weight of the metallized coating may vary and the resulting product may have a rough surface finish.

The build-up of zinc oxide may arise partly as a result of the reaction between the molten zinc and the oxygen present in the atmosphere within the shroud. Zinc oxide may also develop from the reaction between zinc and any fluxing agent which is used to pre-treat the wire so as to facilitate the formation of a good bond between the zinc coating and the ferrous metal. Accordingly, mere maintenance of a relatively non-oxidizing atmosphere by the use of an inert gas alone in the vicinity of the location where the wire leaves the surface of the molten zinc is inadequate to obtain the highest quality finish to the galvanized wire.

There is therefore a requirement for a method and apparatus for treating freshly metallized substrates which avoids the build-up of metal oxide around the surface of the molten metal.

SUMMARY OF THE INVENTION

The present invention is generally directed to a method and apparatus for treating a freshly metallized substrate to reduce or prevent oxidation of the molten metal at the surface of the molten metal bath and on the substrate itself. In particular, the present invention is directed to a method and apparatus of treating a freshly metallized substrate comprising passing the substrate through a bath of molten metal to form the metallized substrate, and directing a treating gas comprising a reducing gas, a non-oxidizing gas or combination thereof at a location wherein the metallized substrate leaves the surface of the molten metal bath to form an atmosphere of the treating gas about the metallized substrate to at least reduce oxidation of the molten metal at the surface of the bath.

BRIEF DESCRIPTION OF THE INVENTION

The following drawings are illustrative of embodiments of the invention and are not intended to limit the invention as encompassed by the claims forming part of the application.

FIG. 1 is a cross-sectional view of one embodiment of the present invention; and FIG. 2 is a cross-sectional view of another embodiment of the present invention.

DETAILED DESCRIPTION OF THE INVENTION

Figure 1:
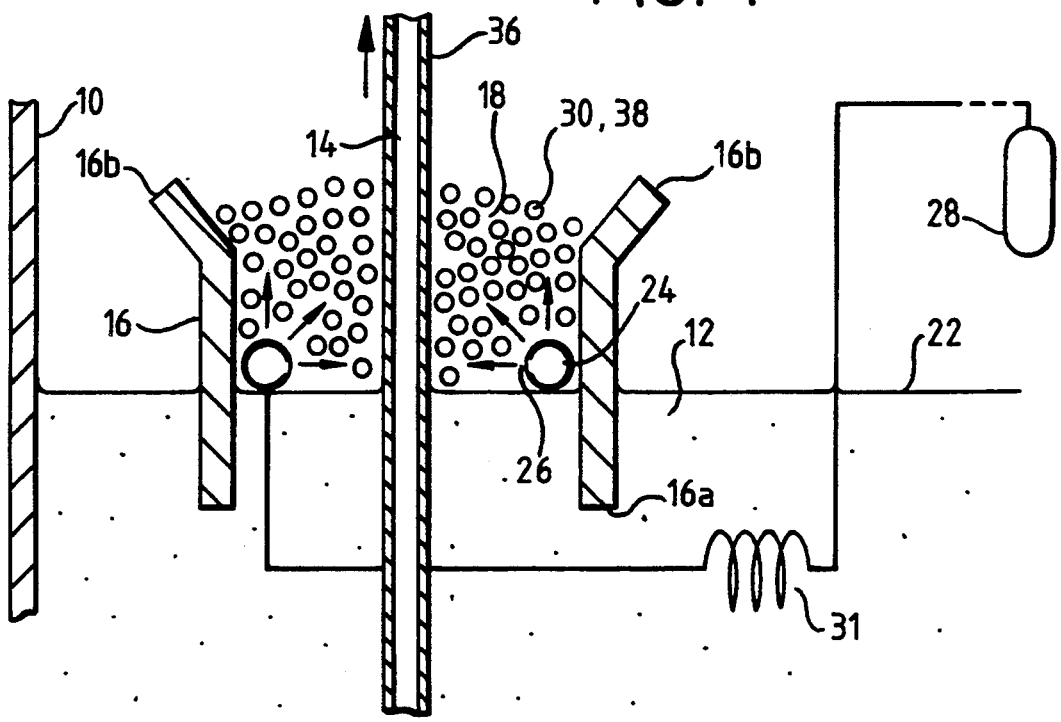

It will be appreciated that by providing an atmosphere of a treating gas at the surface of the molten metal bath rather than just an atmosphere having a reduced oxygen presence, it is possible to actively exclude the effect of oxygen on the metal coating process. As a consequence, oxidation of the molten metal at the surface of the molten metal bath is reduced or prevented. As used herein the phrase "reducing or preventing oxidation" of the molten metal at the surface of the molten metal bath shall mean at least reducing oxidation of the metal coated on the substrate as well the metal on the surface of the bath itself. As further used herein the term non-oxidizing gas is intended to include all gases which neither reduce nor oxidize the metal. Most common among the non-oxidizing gases for use in the present invention are inert gases such as nitrogen, argon and the like.

Advantageously, the present method employs a treating gas comprising the combination of a substantially inert gas and an oxygen-reducing gas. Such a treating gas will facilitate the active reduction of any trace oxygen present either in the substantially inert gas or introduced from the surrounding atmosphere.

The treating gas may be pre-heated by, for example, passing it through the molten metal to thereby reduce any tendency of the treating gas to chill the surface of the metal after it has been deposited on the substrate.

The treating gas may be released below the surface of the molten metal and allowed to rise to the surface where it is released therefrom. This arrangement insures a supply of the treating gas to the critical region where the substrate leaves the surface and promotes movement of the molten metal which may further reduce the possibility of metal oxide forming at the surface. Alternatively, and more conveniently, the treating gas may be directed at the surface of the molten metal by releasing it above the surface thereof.

Advantageously, the oxygen-reducing gas may be selected from the group consisting of saturated and unsaturated hydrocarbons, alcohols, such as lower alkanols (e.g. methanol and ethanol), hydrogen, ammonia and carbon monoxide. The preferred gases are CO, $CH_4$, $H_2$, $C_3H_8$, $C_2H_2$, $C_3H_6$, and $NH_3$.

In another aspect of the present invention there is provided an apparatus for treating a freshly metallized substrate with molten metal, comprising (a) a bath of the molten metal, (b) means for passing the substrate through the molten metal to form a metallized substrate, and (c) directing means for intermittently or continuously directing a treating gas comprising a reducing gas, a non-oxidizing gas, or combination thereof at the surface of the molten metal at a location where the metallized substrate leaves the surface of the molten metal bath. There is thus formed an atmosphere of the treating gas about the metallized substrate to at least reduce oxidation of the molten metal at the surface of the molten metal bath.

Advantageously, the apparatus further includes containers for supplying the individual gases such as a substantially inert gas and an oxygen-reducing gas to a gas mixing apparatus for mixing to form the treating gas prior to delivery. The apparatus may further include a container for supplying the gas to a gas mixing panel to produce the required mixture.

Heater means may be provided for heating the treating gas or components thereof prior to contact of the treating gas with the surface of the molten metal, thereby reducing the possibility of the treating gas chilling the molten metal as it is deposited on the substrate. The heater means may comprise a pipe immersed in said molten metal through which said treating gas is passed prior to being directed at the surface of the molten metal.

The directing means may comprise an outlet nozzle positioned beneath the surface of the molten metal bath to thereby allow the released treating gas to rise to the surface of the molten metal bath and to be released therefrom. Such an arrangement has the advantage of ensuring the required gaseous atmosphere at the surface of the molten metal bath and also acts to promote movement of the molten metal to further reduce the formation of metal oxide. Alternatively, the outlet nozzle may be positioned above the surface of said molten metal bath to thereby direct the treating gas at the surface of said molten metal.

In a particularly advantageous arrangement the apparatus further comprises a porous medium surrounding the location where the metallized substrate leaves the surface of the molten metal bath. Such an arrangement helps maintain the presence of the desired atmosphere of the treating gas in said location and can also help control the thickness of the metal coating. The preferred porous medium is an arrangement of ceramic refractory balls.

Referring to FIG. 1, there is shown a part of a bath or tank 10 containing a volume of molten metal 12, (such as, for example, molten zinc), through which a metal substrate such as a ferrous wire 14 is passed to provide the wire 14 with a metal coating 36 which rapidly solidifies once the wire emerges from the bath 10. A system of pulleys (not shown) is provided to lift the wire vertically from the bath 10. The emerging wire 14 is surrounded by a hollow, open-ended generally vertically disposed, cylindrical shroud 16 of refractory material. A region 18 for the emerging wire 14 is defined by the shroud 16 whose lower end **16*a* is submerged typically up to a few centimeters below the normal level of the surface 22 of the molten metal 12. An upper end 16*b* of the shroud 16 is located typically up to one meter above the level of the surface 22. A manifold 24 having a plurality of outlet nozzles 26 is provided just above the surface 22. A cylinder of gas 28 is linked to a pipe 30 which passes through the molten metal 12 via a heating coil 31 and is connected to the manifold 24 for the supply of gas thereto. The region defined by the shroud 16 and immediately surrounding the wire 14 is preferably filled with a porous medium such as, for example, ceramic balls 38**.

Figure 2:
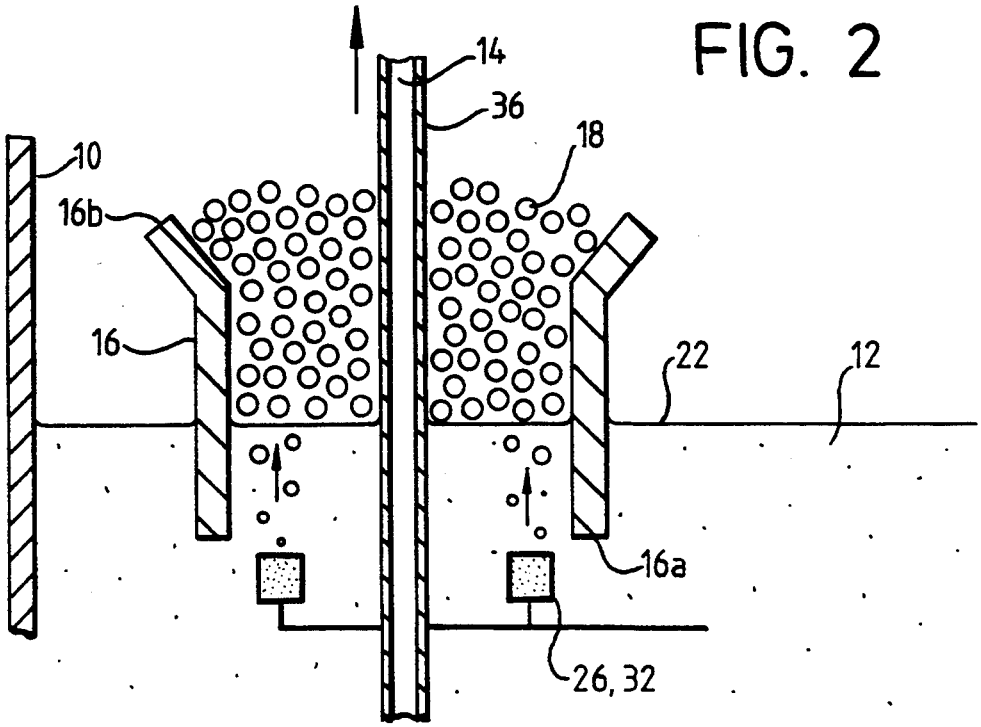

A second arrangement is shown in FIG. 2. This arrangement differs from that shown in FIG. 1 in one material respect, namely, the positioning of the gas outlet nozzles. In the embodiment of FIG. 2, the outlet nozzles shown by numeral 32 are positioned below the surface of the molten metal 12. In operation, any gas released therefrom forms bubbles 34 which rise to the surface of the molten metal 12 and are released therefrom in the region where the wire 14 emerges from the molten metal bath 12.

As an alternative to the use of nozzles, there may be used an annular porous plug (also shown by numeral 32) formed from, for example, sintered metal or graphite or other refractory material. The plug 32 may be of a kind commonly used in metallurgy to pass bubbles of gas into a volume of molten metal. The plug 32 is linked to the gas supply 28 (see FIG. 1) via the pipe 30 in the same manner as that described above and allows the treating gas passed therethrough to be diffused through the sintered material and into the molten metal 12. The gas then rises to the surface in the form of bubbles 34 and acts in the manner described above.

The treating gas used to form the atmosphere at the surface of the molten metal comprises a reducing gas, a non-oxidizing gas or combination thereof and may, for example, comprise the combination of a substantially inert gas and an oxygen-reducing gas. The inert gas acts as a carrier for the oxygen-reducing gas to reduce any trace elements within the substantially inert gas thereby providing a treating gas which is a reducing gas or a non-oxidizing gas. The carrier gas may comprise an inert gas such as nitrogen, argon or the like and the reducing gas may comprise one or more gases selected from saturated and unsaturated hydrocarbons, alcohols, hydrogen, ammonia, and carbon monoxide as described previously. It will, however, be appreciated that other combinations may be used as long as the overall gas combination is generally reducing or non-oxidizing.

In the operation of the embodiment shown in FIG. 1, a stream of treating gas is passed into and through nozzles 26 until the region surrounding the position where the wire 14 exits the molten metal 12 contains a reducing or non-oxidizing atmosphere. Once this has been achieved, the wire 14 is drawn upwardly from the molten metal 12 and passes through the reducing or non-oxidizing atmosphere. As a result, the molten metal deposited in the form of a coating on said wire is allowed to solidify to form the metallized wire. Solidification takes place without the presence of oxygen thereby preventing oxidation of the metal coating 36 as the wire 14 is withdrawn from the molten metal.

The porous medium 38 within the region 18 may comprise a plurality of ceramic balls having an approximate diameter in the range of 0.5 mm to 1.0 mm loosely piled on top of each other. The porous medium defines a labyrinth of passageways in which the released gas is trapped to thereby establish an atmosphere of the treating gas. While the loss of treating gas from the region 18 depends on the rate of supply of the gases comprising the treating gas, the porous medium allows lower flow rates to be used and prevents the ingress of air from drafts and the like. The porous medium 38 also provides a longer gas residence time in vicinity of the wire 14 which allows any reactive gases to crack or react with any oxygen present. The porous medium 38 also comes into direct contact with the wire 14 as it is drawn upwardly from the molten metal 12 and thereby provides a mechanical "brush" effect to control the coating thickness and reduce the possibility of an uneven surface coating resulting from undesirable running or dripping of the molten metal.

In the operation of the embodiment shown in FIG. 2, the treating gas is released in the form of bubbles which rise toward the surface of the molten metal. As the bubbles of treating gas are released from the molten metal they form the desired reducing or non-oxidizing atmosphere immediately above the surface of the molten metal. This arrangement has two advantages over the embodiment of FIG. 1. Firstly, it is possible to ensure that a reducing or non-oxidizing atmosphere is created in the critical area immediately above the surface of the molten metal, thereby further reducing the possibility of metal oxide forming at the surface. Secondly, the rising gas can be used to promote the flow of molten metal within the molten metal bath thereby causing the surface thereof to be continuously renewed which further reduces the possibility of metal oxide forming at the surface.

What is claimed:

1. A method of treating a metallized substrate comprising:

a) passing the substrate through a bath of molten metal having an upper surface to form the metallized substrate;

b) providing a treating gas comprised of a reducing gas, a substantially inert gas or combination thereof at a location where the metallized substrate leaves the upper surface of the bath; and c) providing a porous medium at said location thereby temporarily trapping the treating gas to form an atmosphere of the treating gas about the metallized substrate to reduce any oxidation of the molten metal which may take place at the upper surface of the bath.

2. The method of claim 1, wherein the treating gas comprises the combination of a substantially inert gas and a reducing gas.

3. The method of claim 1, further comprising preheating the treating gas prior to providing said treating gas at the surface of the molten metal.

4. The method of claim 3, wherein the step of preheating the treating gas comprises passing the treating gas through the molten metal bath.

5. The method of claim 1, comprising releasing the treating gas below the upper surface of the molten metal bath and allowing the treating gas to rise to and above the upper surface of the molten metal bath.

6. The method of claim 1, comprising releasing the treating gas above the upper surface of said molten metal bath.

7. The method of claim 1, wherein the reducing gas is selected from the group consisting of saturated and unsaturated hydrocarbons, alcohols, hydrogen, ammonia and carbon monoxide.

8. The method of claim 7, wherein the reducing gas is a hydrocarbon selected from the group consisting of $CH_4$, $C_3H_6$, $C_3H_8$ and $C_2H_2$.

* * * * *